US009364717B2

(12) United States Patent
Davis et al.

(10) Patent No.: US 9,364,717 B2
(45) Date of Patent: Jun. 14, 2016

(54) SWIMMING FIN

(71) Applicants: Kathleen Davis, Los Angeles, CA (US); Don Reardon, Portland, OR (US); Damon Clegg, Portland, OR (US)

(72) Inventors: Kathleen Davis, Los Angeles, CA (US); Don Reardon, Portland, OR (US); Damon Clegg, Portland, OR (US)

( * ) Notice: Subject to any disclaimer, the term of this patent is extended or adjusted under 35 U.S.C. 154(b) by 18 days.

(21) Appl. No.: 14/157,448

(22) Filed: Jan. 16, 2014

(65) Prior Publication Data

US 2015/0196808 A1 Jul. 16, 2015

(51) Int. Cl.
*A63B 31/08* (2006.01)
*A63B 31/11* (2006.01)

(52) U.S. Cl.
CPC ..... *A63B 31/11* (2013.01); *A63B 2209/00* (2013.01); *A63B 2225/605* (2013.01)

(58) Field of Classification Search
CPC ..... A63B 31/11
See application file for complete search history.

(56) References Cited

U.S. PATENT DOCUMENTS

| | | | | |
|---|---|---|---|---|
| 915,457 | A | | 3/1909 | Marrotte |
| 1,398,130 | A | | 11/1921 | Deri |
| 1,590,484 | A | | 6/1926 | Volker |
| 1,786,451 | A | | 12/1930 | Ribard |
| 1,841,904 | A | | 1/1932 | McGowan |
| 1,983,609 | A | | 12/1934 | Hudson |
| 2,099,973 | A | | 11/1937 | De Corlieu |
| D124,013 | S | | 12/1940 | Churchill |
| 2,321,009 | A | | 6/1943 | Churchill |
| 2,588,363 | A | | 3/1952 | De Corlieu |
| 2,672,629 | A | | 3/1954 | La Trell |
| 2,889,563 | A | | 6/1959 | Lamb et al. |
| 3,019,458 | A | | 2/1962 | De Barbieri Ettore et al. |
| 3,055,025 | A | | 9/1962 | Ferraro et al. |
| 3,183,529 | A | | 5/1965 | Beuchat |
| D203,364 | S | | 12/1965 | Brunner |
| 3,411,165 | A | | 11/1968 | Murdoch |
| 3,422,470 | A | * | 1/1969 | Mares ..... 441/64 |
| 3,649,979 | A | | 3/1972 | MacNiel |
| 3,671,987 | A | | 6/1972 | Mayor |
| 3,913,158 | A | | 10/1975 | Vilarrubis |
| 3,922,741 | A | | 12/1975 | Semeia |
| 4,007,506 | A | | 2/1977 | Rasmussen |
| 4,055,174 | A | | 10/1977 | LeVasseur |
| 4,083,071 | A | | 4/1978 | Forjot |
| 4,310,938 | A | | 1/1982 | Eichler |
| 4,521,220 | A | | 6/1985 | Schoofs |

(Continued)

FOREIGN PATENT DOCUMENTS

| | | |
|---|---|---|
| EP | 1192974 | 4/2002 |
| FR | 2611509 | 9/1988 |

(Continued)

OTHER PUBLICATIONS

Speedo Training Fin, retrieved from the Internet on Oct. 11, 2013, at: <http://www.swimoutlet.com/ProductDetails.asp?ProductCode=5265&Click=310393&subscribe=Y&gclid=COmo0PWzj7oCFbE7Mgodp2UAAg>.

(Continued)

*Primary Examiner* — Edwin Swinehart
(74) *Attorney, Agent, or Firm* — Katten Muchin Rosenman LLP

(57) ABSTRACT

The present invention relates to swimming fins used for strength training in fitness swimming and performance swimming. A swimming fin comprises a fin body having top and bottom surfaces, and proximal and distal ends, the fin body defining an opening at the proximal side and configured to receive a foot. A portion of the distal edge is scalloped.

26 Claims, 13 Drawing Sheets

(56) References Cited

U.S. PATENT DOCUMENTS 4,541,810 A 9/1985 Wenzel
4,627,820 A * 12/1986 Penebre ..... 441/64
4,664,639 A 5/1987 Schneider
4,738,645 A 4/1988 Garofalo
4,775,343 A 10/1988 Lamont et al.
4,787,871 A 11/1988 Tomlinson
4,795,384 A 1/1989 Hattori
4,795,385 A 1/1989 Matsuoka
4,820,218 A 4/1989 Van De Pol
4,887,985 A 12/1989 Garofalo
4,913,418 A 4/1990 Schlueter et al.
4,923,419 A 5/1990 McCarthy
4,929,206 A 5/1990 Evans
4,948,385 A 8/1990 Hall
4,954,111 A 9/1990 Cressi
4,954,112 A 9/1990 Negrini et al.
D313,640 S 1/1991 Fujiwara
5,078,633 A 1/1992 Tolbert, Jr.
5,108,328 A 4/1992 Hull
D327,933 S 7/1992 Evans
D327,935 S 7/1992 Evans
5,163,859 A 11/1992 Beltrani et al.
5,266,062 A 11/1993 Runckel
5,273,469 A 12/1993 Lueschen
5,292,272 A 3/1994 Grim
5,304,081 A 4/1994 Takizawa
D349,552 S 8/1994 Fleming
D350,801 S 9/1994 Dagnino
5,358,439 A 10/1994 Paolo
5,362,268 A 11/1994 Nordbeck et al.
5,374,210 A 12/1994 Sardella et al.
D355,012 S 1/1995 Robertson
5,387,145 A 2/1995 Wagner
5,417,599 A 5/1995 Evans
5,435,764 A * 7/1995 Testa et al. ..... 441/64
5,443,593 A 8/1995 Garofalo
5,522,748 A 6/1996 Cressi
5,542,865 A 8/1996 Alvarez De Toledo
5,545,067 A 8/1996 Garofalo
5,588,890 A 12/1996 Garofalo
5,607,334 A 3/1997 Garofalo
D379,398 S 5/1997 Garraffa
5,643,027 A 7/1997 Evans et al.
D382,322 S 8/1997 Cressi
5,656,323 A 8/1997 Underdown
5,702,277 A 12/1997 Wagner
5,709,575 A * 1/1998 Betrock ..... 441/64
5,746,631 A 5/1998 McCarthy
5,766,050 A 6/1998 Maggi
5,813,889 A 9/1998 Perry et al.
5,868,593 A 2/1999 Feng
5,906,525 A 5/1999 Melius et al.
5,941,747 A 8/1999 Garofalo
5,975,973 A 11/1999 Fleming
D421,474 S 3/2000 Godoy
D423,623 S 4/2000 Evans
6,050,868 A 4/2000 McCarthy
6,053,788 A 4/2000 Garofalo
6,095,879 A 8/2000 McCarthy
6,146,224 A 11/2000 McCarthy
6,152,794 A 11/2000 Liu
6,179,675 B1 1/2001 Godoy
6,224,443 B1 5/2001 Mehrmann et al.
6,227,924 B1 5/2001 Miller
6,276,978 B1 8/2001 Chen
6,290,560 B1 9/2001 Kidd et al.
D450,365 S 11/2001 Evans
6,341,383 B1 1/2002 Beltrani
6,364,728 B1 4/2002 Viale et al.
6,371,821 B1 4/2002 McCarthy
6,379,203 B1 4/2002 Kuo
6,394,863 B1 5/2002 Chen
6,398,604 B1 6/2002 Kawashima et al.
6,401,256 B1 6/2002 Shreve
6,413,133 B1 7/2002 McCarthy
6,435,926 B1 8/2002 Yeh
D463,840 S 10/2002 Reeder
6,482,059 B2 11/2002 McCarthy
6,497,597 B2 12/2002 McCarthy
D470,557 S 2/2003 Godoy
6,520,816 B1 2/2003 Hu
6,568,972 B2 5/2003 Kawashima et al.
6,568,973 B2 5/2003 Testa
6,568,974 B2 5/2003 Semeia
6,568,975 B1 5/2003 Perry et al.
6,585,548 B2 7/2003 McCarthy
6,607,411 B1 8/2003 McCarthy
6,620,009 B1 9/2003 Jermyn
6,663,452 B1 12/2003 Myers
6,712,656 B2 3/2004 McCarthy
6,719,599 B2 4/2004 McCarthy
D490,136 S 5/2004 Godoy
6,843,693 B2 1/2005 McCarthy
6,866,615 B2 3/2005 Ryland
6,884,134 B2 4/2005 McCarthy
6,884,135 B2 4/2005 Hu
6,884,136 B1 4/2005 McCarthy
6,918,805 B2 7/2005 McCarthy
6,923,697 B1 * 8/2005 Wagner ..... 441/64
6,926,569 B1 8/2005 Hsieh
6,955,575 B1 10/2005 Hsieh
6,979,241 B2 12/2005 Hull
7,018,256 B2 3/2006 McCarthy
7,033,533 B2 4/2006 Lewis-Aburn et al.
7,048,601 B2 5/2006 Sclafani
7,077,715 B2 7/2006 Vassallo
7,083,485 B2 8/2006 Melius
7,086,916 B2 8/2006 Godoy
7,101,240 B2 9/2006 McCarthy
7,115,011 B2 10/2006 Chen
7,134,926 B2 11/2006 Moeller et al.
7,134,927 B1 11/2006 Johnson
7,140,937 B2 11/2006 Cadorette
7,140,938 B1 11/2006 Ware
D534,983 S 1/2007 Testa
7,159,336 B2 1/2007 Burns et al.
7,166,004 B2 1/2007 Wilson
7,172,480 B2 2/2007 Abbott
7,189,128 B2 3/2007 Halliday
7,223,141 B1 * 5/2007 Shiue ..... 441/64
7,255,619 B2 8/2007 Rasmussen
D553,218 S 10/2007 Keegan
7,281,963 B1 10/2007 Feng
7,335,076 B2 2/2008 Hull
7,435,149 B2 10/2008 Bastiao
7,462,085 B2 12/2008 Moyal
7,465,205 B2 12/2008 McCarthy
7,470,164 B2 12/2008 Moyal
7,510,453 B2 3/2009 Nguyen
7,527,540 B2 5/2009 Melius
7,527,845 B2 5/2009 King et al.
7,537,501 B2 5/2009 Godoy
7,572,160 B2 8/2009 Halliday
7,581,997 B2 9/2009 McCarthy
7,601,041 B2 10/2009 McCarthy
7,614,928 B2 11/2009 Grivna
7,658,659 B1 2/2010 Fraser et al.
7,736,208 B2 6/2010 Bonis et al.
7,753,749 B2 7/2010 Mun et al.
7,794,364 B2 9/2010 Killgore et al.
7,803,028 B2 9/2010 Melius
7,815,477 B2 10/2010 Garofalo
7,828,615 B2 11/2010 Bonis et al.
7,854,638 B2 12/2010 Twombly
7,862,395 B2 1/2011 McCarthy
7,901,260 B2 3/2011 Godoy
8,251,764 B2 8/2012 Hsu
8,257,124 B2 9/2012 Garofalo
2001/0016461 A1 8/2001 Kawashima et al.
2002/0039865 A1 4/2002 Semeia
2004/0053547 A1 3/2004 Godoy
2004/0248481 A1 12/2004 McCarthy
2005/0003719 A1 1/2005 McCarthy
2005/0176318 A1 8/2005 McCarthy

(56) References Cited

U.S. PATENT DOCUMENTS

| | | | |
|---|---|---|---|
| 2005/0181689 | A1 | 8/2005 | McCarthy |
| 2005/0186866 | A1 | 8/2005 | McCarthy |
| 2005/0215137 | A1 | 9/2005 | Vassallo |
| 2006/0068659 | A1 | 3/2006 | Abbott |
| 2006/0249630 | A1 | 11/2006 | McCarthy |
| 2006/0264499 | A1 | 11/2006 | Wright et al. |
| 2007/0032147 | A1 | 2/2007 | McCarthy |
| 2007/0032148 | A1 | 2/2007 | McCarthy |
| 2007/0037459 | A1 | 2/2007 | McCarthy |
| 2007/0049140 | A1 | 3/2007 | McCarthy |
| 2007/0072497 | A1 | 3/2007 | Hull |
| 2007/0077831 | A1 | 4/2007 | Kuo |
| 2007/0077832 | A1 | 4/2007 | Godoy |
| 2007/0173143 | A1 | 7/2007 | McCarthy |
| 2008/0045095 | A1 | 2/2008 | McCarthy |
| 2008/0108258 | A1 | 5/2008 | McCarthy |
| 2009/0149093 | A1 | 6/2009 | Grivna |
| 2010/0029152 | A1 | 2/2010 | Fraser |
| 2010/0029153 | A1 | 2/2010 | Testa |
| 2012/0071047 | A1 | 3/2012 | Noceti |
| 2013/0183877 | A1 | 7/2013 | Fraser |

FOREIGN PATENT DOCUMENTS

| | | |
|---|---|---|
| GB | 746764 | 3/1956 |
| GB | 1223664 | 3/1971 |
| JP | 07213650 | 8/1995 |
| WO | 9425116 | 11/1994 |

OTHER PUBLICATIONS

Aqua Sphere Alpha Fins, Retrieved from the internet on Oct. 11, 2013, at: http://www.swimoutlet.com/ProductDetails.asp?ProductCode=5265&Click=310393&subscribe=Y&gclid=COmo0PWzj7oCFbE7Mgodp2UAAg.
Speedo Glide Fin, Downloaded Jun. 6, 2008.
Torpedo Swim Fin, Downloaded May 16, 2007.
Vapor Swim Fin, Image taken Jun. 7, 2007.

* cited by examiner

SWIMMING FIN

FIELD

The present invention relates to fin accessories used in water related activities. More particularly, the present invention relates to swimming fins used for strength training in fitness swimming and performance swimming, which can enable a swimmer to swim faster and for longer periods of time when not using the fins.

BACKGROUND

There are various types of swimming and diving fins with diverse features and properties for use in pools and in the open water, by athletes, snorkelers, scuba divers, lifeguards, and others. Swimming fins are one type of fin that is used in fitness swimming or in performance training for competitive swimming sports. Such swimming fins can add resistance to a swimmer's kick and thereby provide the strength training that would ultimately allow a swimmer to swim faster and for longer than without the fins.

Swimming fins are primarily designed to increase the surface area of a swimmer's foot in order to add more propulsion force that would allow a swimmer to swim faster. Maintaining a higher speed of swimming generally requires more work and sustained exertion of energy from a swimmer, and thus can help build a swimmer's strength. For example, a swimmer attempting to swim at the same high speed without the fins would tire out faster and be unable to maintain that pace for a long period of time, and thus be unable to build the same amount of muscle as when using the fins. Thus, while swimming fins primarily cause a swimmer to swim faster when in use, they provide secondary benefits in gradual strength training. However, improvements can be made to conventional swimming fins that, for example, are designed with the primary goal of increasing swimming speeds rather than maximizing the resistance load to the swimmer's kick.

Various improvements have been made to swimming fins through the years, depending on their use and purpose. Certain improvements have been inspired by the natural swimming features of aquatic animals or marine mammals. For example, many swimming fins are based on the webbed footing design of animals such as ducks, which increases propulsion force by providing an improved oar-like pushing against the resistance of water and an improved recovery stroke. Other animals use different systems of propulsion based on a more flexible blade and a wing-like type of movement to simulate, for example, a whale's tail (see, e.g., U.S. Pat. Nos. 5,906,525; 5,906,525; 4,541,810) or a dolphin's tail (see, e.g., U.S. Pat. Nos. 2,321,009; 4,055,174). However, the features of small aquatic animals or large marine mammals are not always compatible with the biomechanics of a human swimmer. For example, the swimming fin shaped like a dolphin's tail disclosed in U.S. Pat. No. 4,055,174 achieves good aquatic properties, but by connecting the swimmer's feet together, forces the swimmer to kick in an unnatural and inefficient manner (and further precludes walking with the fins). While the 'biomimicry' of certain features in aquatic animals can be useful and may provide certain advantages in propulsion force or fluid dynamics that can improve a swimmer's kick, swimming fins should not so closely simulate the features of animals as to disregard the natural mechanical functions and balance of a human or cause a swimmer's body to be thrown off its ideal swimming position in the water.

Swimming fins are typically of one of two types—the closed foot type or the open heel type with a fastening strap.

The closed foot type of fin is generally shaped like a shoe, with a cavity at the base shaped to fit a user's heel, and a foot pocket extending into the fin from the cavity. While the closed foot type has the advantage of providing stability and secure connection to the foot by providing a rigid edge to a user's heel and support to at least a part of the ankle, it does not allow much flexion to the ankle and thus inhibits the full extent of a swimmer's kick and natural swimming motions. The closed foot type of fin also has the disadvantage of being burdensome to manufacture because like regular shoes, it must be formed in various sizes to fit each individual foot size. However, open heel fins do not provide as much stability or security as the closed heel type of fin since they do not sufficiently support a swimmer's heels. In addition, the strap of an open heel fin may add stress to the back of a swimmer's heel, for example in the Achilles tendon area, and cause discomfort to a swimmer.

Thus, there is a need to address these and other problems to improve swimming fins for use as a training accessory for fitness and performance swimming, for the purpose of building the strength that can enable a swimmer to swim faster and for longer periods of time when not using the fins.

SUMMARY

The present disclosure provides a swimming fin for building a swimmer's strength in fitness swimming and performance training. More particularly, embodiments of the present invention relate to a swimming fin comprising a fin body having top and bottom surfaces, proximal and distal sides, and lateral and medial sides, the fin body defining an opening at the proximal side and configured to receive a foot. According to an embodiment, a portion of a side of the fin body is scalloped.

According to one aspect, a portion of the lateral side and a portion of the distal side of the fin body are scalloped.

According to another aspect, the fin body comprises a flow channel extending across a portion of the top surface or a portion of the bottom surface of the fin body, the flow channel configured to direct water across the flow channel.

According to another aspect, the fin body comprises a first flow channel extending across a portion of the bottom surface and a second flow channel extending across a portion of the top surface of the fin body, wherein the first and second flow channels extend to an aperture formed through the top and bottom surfaces of the fin body, the first and second flow channels configured to direct water across the channels and through the aperture According to another aspect, the swimming fin comprises a foot securing portion connected to the proximal side for securing a foot inserted into the fin body through the opening, wherein the foot securing portion comprises a back heel strap integrated with an under heel strap.

According to another aspect, the fin body is formed of a buoyant material.

According to another aspect, the buoyant material is an ethylene vinyl acetate (EVA) foam.

According to another aspect, the fin body defines a foot pocket configured to house a foot, and the foot pocket is molded by a foot last.

According to another embodiment of the invention, a swimming fin comprises a fin body having top and bottom surfaces, proximal and distal sides, and lateral and medial sides, the fin body defining an opening at the proximal side and configured to receive a foot. The fin body comprises a first flow channel extending across a portion of the top surface of the fin body or a portion of the bottom surface of the fin body, wherein the flow channel extends to an aperture formed through the top and bottom surfaces of the fin body, the flow channel configured to direct water across the flow channel and through the aperture.

According to one aspect, the flow channel is a planar groove extending from the lateral side of the fin body to the aperture positioned near the medial side of the fin body.

According to another aspect, the aperture is rectangular.

According to another aspect, the flow channel is tapered from one end near the aperture to another end on the fin body.

According to another aspect, the fin body further comprises a second flow channel extending across a portion of the top surface of the fin body, wherein the second flow channel extends to the aperture, the second flow channel configured to direct water across the channel and through the aperture, and wherein the first flow channel extends across a portion of the bottom surface of the fin body.

According to another aspect, wherein the fin body comprises a plurality of flow channels extending across a portion of the top surface of the fin body and a portion of the bottom surface of the fin body, and a plurality of apertures formed through the top and bottom surfaces of the fin body, wherein the channels in the plurality of flow channels extend to the apertures in the plurality of apertures.

According to another aspect, a portion of a side of the fin body is scalloped.

According to another aspect, the fin body is formed of a buoyant material.

According to another aspect, the swimming fin further comprises a foot securing portion connected to the proximal side for securing a foot inserted into the fin body through the opening, wherein the foot securing portion comprises a back heel strap integrated with an under heel strap.

According to another aspect, the fin body defines a foot pocket configured to house a foot, and the foot pocket is molded by a foot last.

According to another embodiment of the invention, a swimming fin comprises a fin body having top and bottom surfaces, proximal and distal sides, and lateral and medial sides, the fin body defining an opening at the proximal side and configured to receive a foot. The swimming fin comprises a foot securing portion connected to the proximal side of the fin body for securing a foot inserted into the fin body through the opening, wherein the foot securing portion comprises a back heel strap and an under heel strap.

According to an aspect, the under heel strap and the back heel strap are integrated with the fin body by a single material.

According to another aspect, the back heel strap comprises an opening extending across the back heel strap.

According to another aspect, the back heel strap comprises a plurality of openings extending across the back heel strap.

According to another aspect, a portion of a side of the fin body is scalloped.

According to another aspect, the swimming fin further comprises a plurality of flow channels extending across a portion of the top surface of the fin body and a portion of the bottom surface of the fin body, and a plurality of apertures formed through the top and bottom surfaces of the fin body, wherein the channels in the plurality of flow channels extend to the apertures in the plurality of apertures.

According to another embodiment of the invention, a swimming fin comprises a fin body having top and bottom surfaces, and proximal and distal sides, and lateral and medial sides, the fin body defining an opening at the proximal end and configured to receive a foot. The swimming fin comprises a foot securing portion connected to the proximal side of the fin body for securing a foot inserted into the fin body through the opening, wherein the fin body defines a foot pocket configured to house a foot, and the foot pocket is formed by a foot last.

According to an aspect, the fin body comprises a gripping mechanism positioned near the opening and configured to allow a user to pull the fin body over a foot.

According to another aspect, the gripping mechanism comprises a hole formed through the top surface of the fin body and configured to allow insertion of a finger through the hole.

According to another aspect, the foot pocket is configured to accommodate a user's instep and arch.

According to another aspect, a portion of a side of the fin body is scalloped.

According to another aspect, the swimming fin further comprises a plurality of flow channels extending across a portion of the top surface of the fin body and a portion of the bottom surface of the fin body, and a plurality of apertures formed through the top and bottom surfaces of the fin body, wherein the channels in the plurality of flow channels extend to the apertures in the plurality of apertures.

DESCRIPTION OF THE DRAWINGS

These and other advantages of the present invention will be readily understood with reference to the following specifications and attached drawings wherein.

DETAILED DESCRIPTION

Embodiments of the present invention will be described herein with references to the accompanying drawings.

Figure 1:
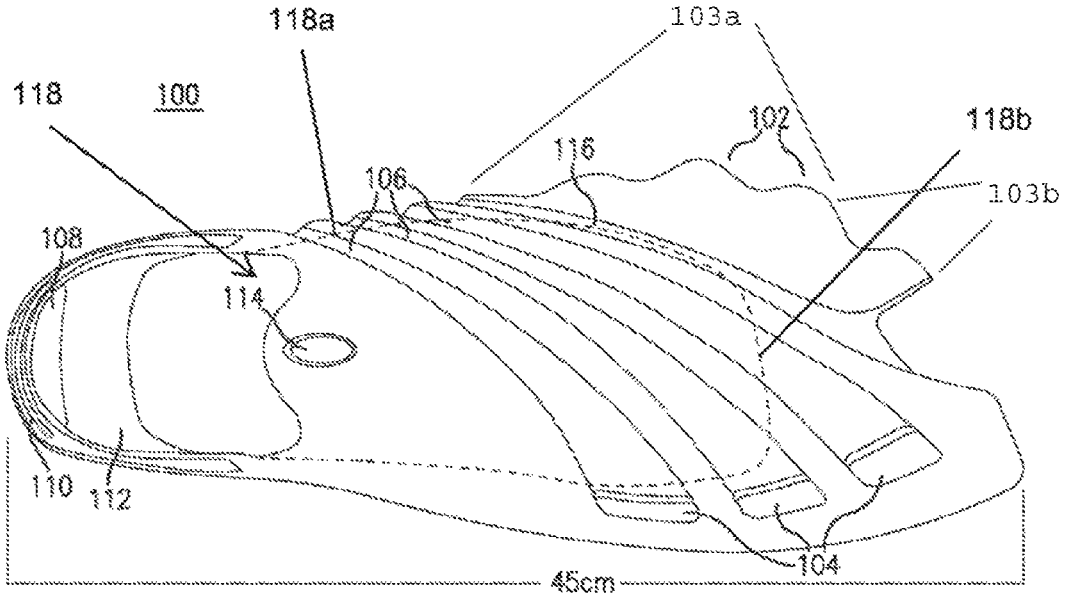
FIG. 1 is a top plan view of a swimming fin according to an embodiment of the invention.
Figure 2:
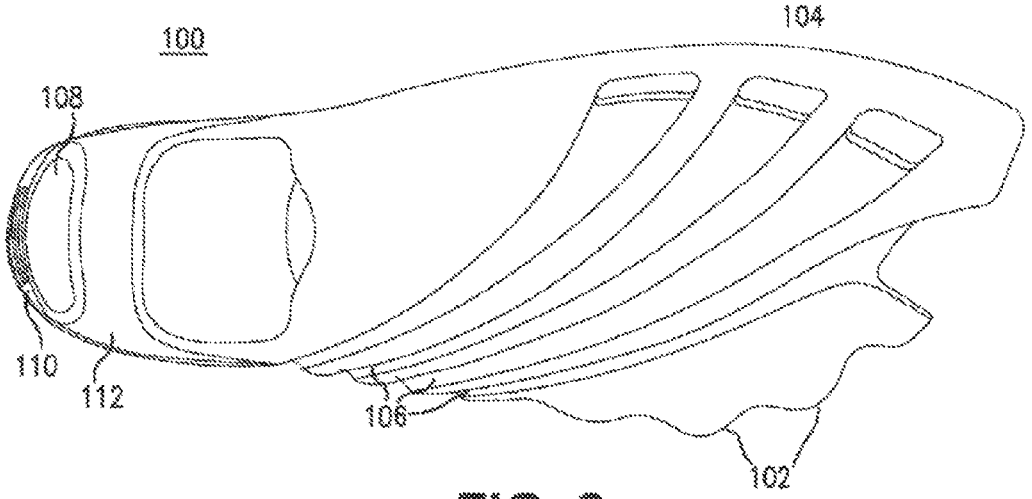
FIG. 2 is a bottom plan view of a swimming fin according to the embodiment of FIG. 1.
Figure 3:
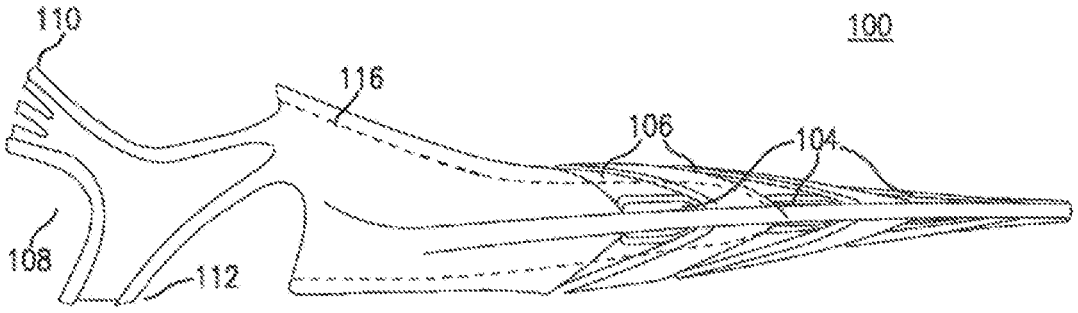
FIG. 3 is a side plan view of a swimming fin according to the embodiment of FIG. 1.

FIG. 1 illustrates a top plan view of a left-foot swimming fin 100 according to an embodiment of the invention. FIG. 2 illustrates a bottom plan view of a swimming fin according to the embodiment of FIG. 1. FIG. 3 illustrates a side plan view of a swimming fin according to the embodiment of FIG. 1.

The hatched lines of FIGS. 1 and 3 illustrate the outline of the foot pocket or cavity inside the swimming fin that houses a swimmer's foot.

Figure 5A:
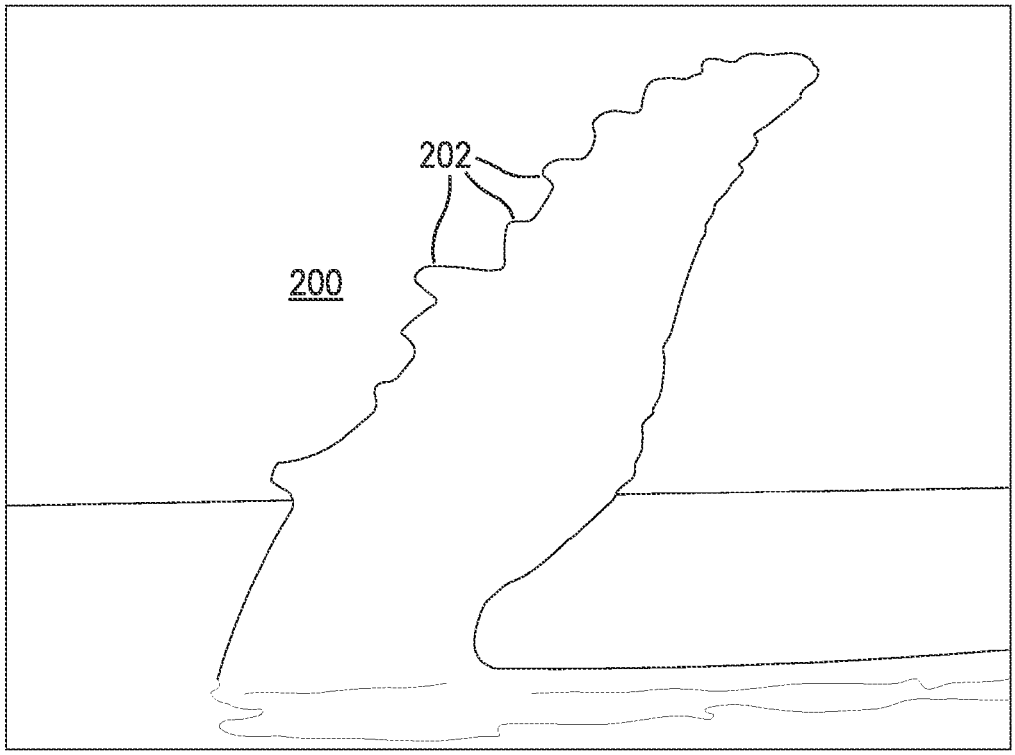
FIGS. 5*a*-5*b* show an illustration and a rendering of a pectoral fin of a humpback whale, as emulated by an embodiment of the invention.
Figure 5B:
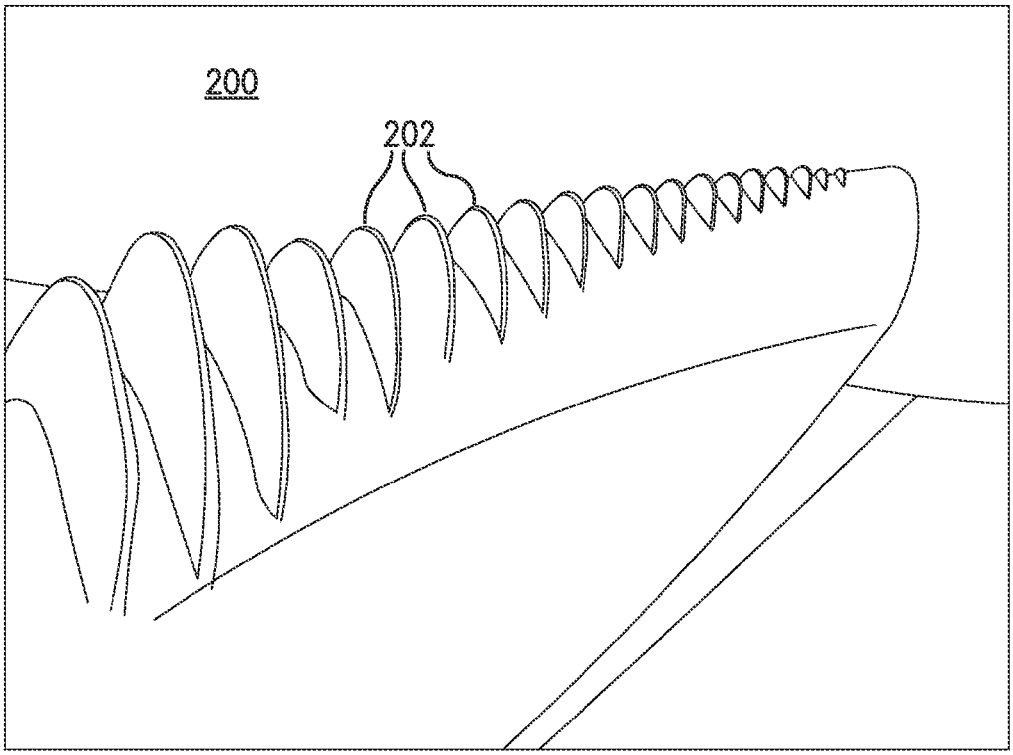

According to an embodiment, the swimming fin 100 may include an irregular edge 102. In particular, the irregular edge 102 has a scalloped shape according to the embodiment shown in FIGS. 1 and 2, and is designed to emulate the pectoral fin of humpback whales. While other swimming fins have notably tried to incorporate features of whales, dolphins and other marine mammals such as the tail, or the caudal fin, none are known to have focused on the unique characteristics of the humpback whale in particular, nor on a whale's pectoral fin 200 as shown in FIGS. 5*a* and 5*b*. Humpback whales are known for their great speeds, maneuverability and other acrobatic characteristics, which are often associated with their unique pectoral fins. Pectoral fins are believed to be similar to stabilizers or rudders of a ship, and can enable the whale to stop and swim backwards. The humpback whale's pectoral fin is especially unique because it is up to one third of the whale's body length, and is proportionally the longest fin of any marine mammal. But, the most identifiable characteristic of the humpback whale is its pattern of bumps, or 'tubercles', found along the edge of the pectoral fin, as shown by 202 in FIGS. 5*a* and 5*b*.

Figure 5C:
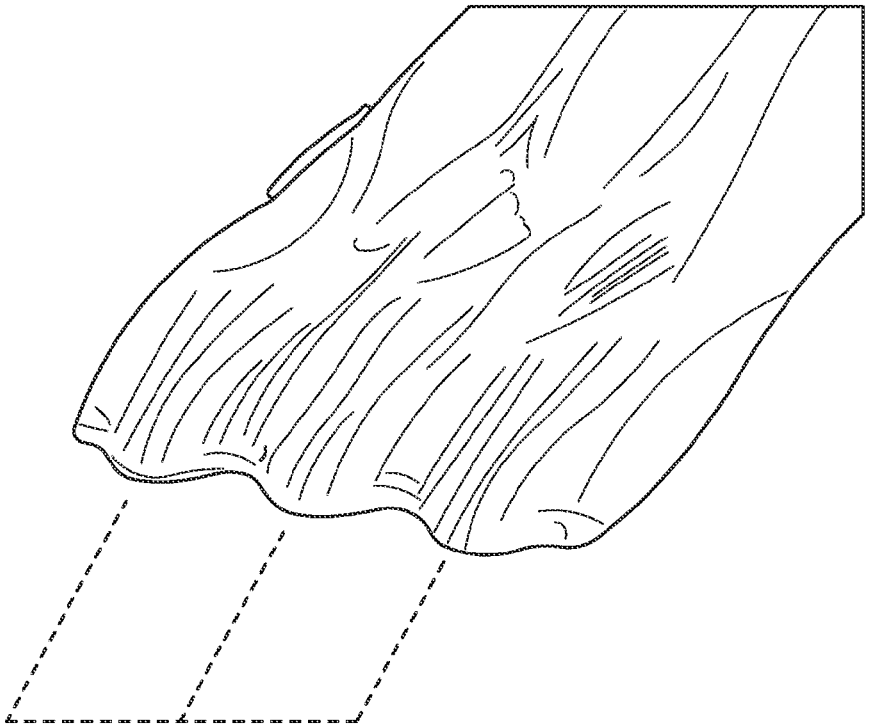
FIG. 5*c* is a perspective schematic view of a pectoral fin of a humpback whale.
Figure 5D:
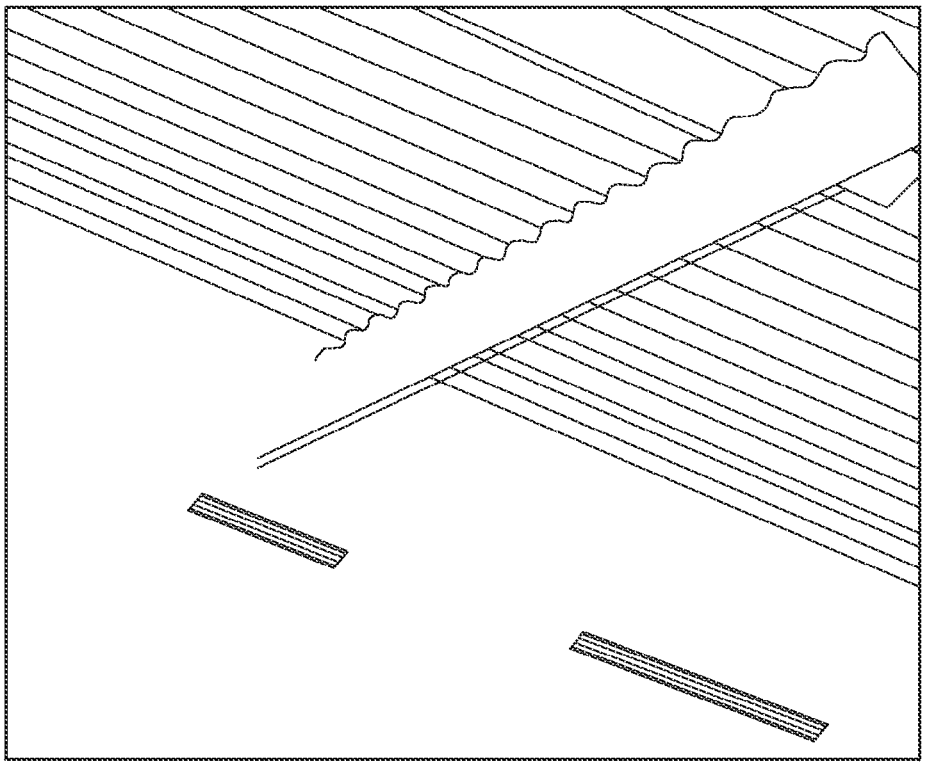
FIG. 5*d* shows a blade manufactured with a scalloped edge for use in turbines and other industrial applications.

Although not limited to theory, it has been reported that the tubercles of the humpback whale's pectoral fins increase propulsion. For example, the tubercles increase the surface area at the edge of the pectoral fin and can thereby cause more water to flow over its irregular edge than over a smooth edge. The increased surface area of the tubercles would thus require the fin to push against more water and accordingly increase propulsion. Moreover, as shown in FIG. 5*c*, large vortices form behind the troughs along the leading edge of a humpback whale's pectoral fin, whereas flow behind the tubercles form straight streamlines. These flow patterns induced by the tubercles are believed to have the effect of significantly improving maneuverability. The increased surface area of the tubercles is also believed to be useful for temperature control when the whale migrates between warm and cold climates. Thus, by scaling its unique flow and temperature phenomena in water to that of air, the humpback whale's pectoral fin has inspired biomimicry for various industrial applications, such as the development of large scale scalloped or tubercle-lined blades as shown in FIG. 5*d*. Accordingly, scalloped blades emulating the whale's fins can be seen in wind turbines, hydroelectric turbines, ventilation fans and even helicopters, for the increased aerodynamic and thermal efficiencies they provide.

Figure 6A:
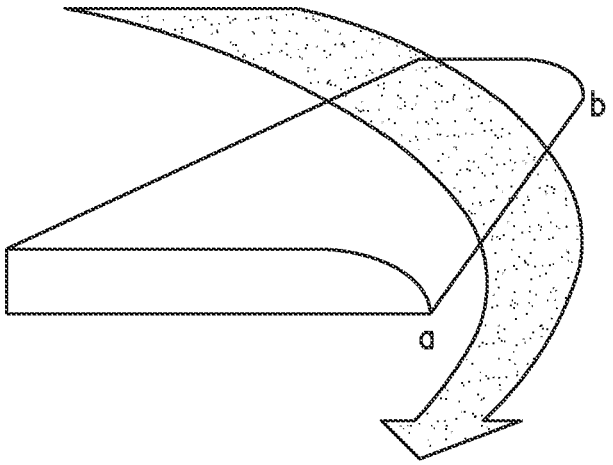
FIG. 6*a* is a perspective schematic view of the direction of flow of a fluid over a straight edge.
Figure 6B:
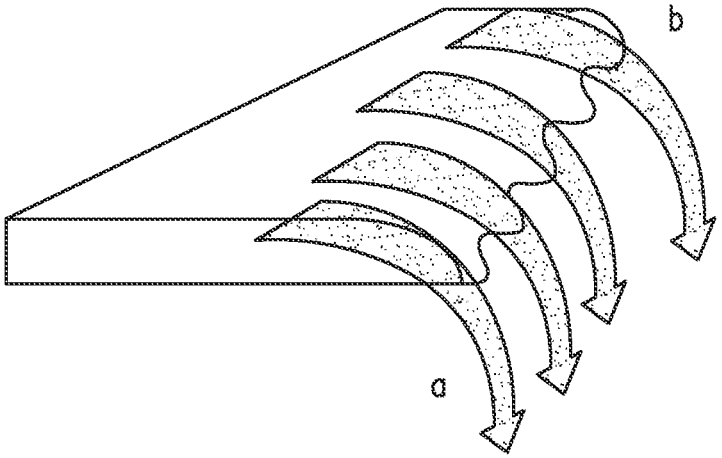
FIG. 6*b* is a perspective schematic view of the direction of flow of a fluid over a scalloped edge.

The scalloped edge 102 according to an embodiment of swimming fin 100 emulates the pectoral fin of the humpback whale to incorporate its unique properties. In particular, the scalloped edge 102 is believed to provide more surface area than a smooth edge, which can cause more water to flow over the scalloped edge and require the swimming fin to push against more water than a smooth edge would. For example, a fin with a straight edge would cause minimal propulsion and minimal lift forces. As shown in FIG. 6*a*, the flow of water would move the shortest possible linear distance, from Point A to Point B. An irregular or scalloped edge, on the other hand, can cause greater propulsion and greater lift by providing more surface area and multiple flow paths, as shown in FIG. 6*b*. Thus, the increased contact surface of an irregular edge can provide greater overall propulsion to a fin. Accordingly, the irregular edge 102 of a swimming fin according to an embodiment would ultimately promote greater propulsion force and swimming speed, which in turn must be powered by more strength from a swimmer than a smooth edge would.

In addition, an irregular edge that is scalloped and emulates the shape of a whale's fin is superior to an irregular edge that is webbed, as seen in conventional fins. In particular, the scalloped edge breaks the surface tension of water more efficiently than a webbed edge. A webbed fin or paddle is essentially like a ping pong paddle with inferior surface break geometric characteristics. In contrast, the scalloped edge allows for a lower resistance on its initial entry into the water, and thus breaks the surface faster with minimized resistance. Once submerged, the drag created by the scalloped edge can be as efficient or less efficient as a webbed edge; however, there is a significant advantage in the flow of momentum, as a result of the consistent momentum that the scalloped edge creates. For example, when a swimmer kicks, his foot may come slightly out of the water and when traveling through ambient air, will move at high speeds with minimal resistance. When the swimmer's foot re-enters the water surface, there is an immediate and sharp decrease in momentum. A webbed fin is likewise highly disruptive. The scalloped edge, however, does not cause as disruptive a loss in momentum, because of its ability to break the water tension, and allows for a more uniform speed. Moreover, as the swimmer kicks and alternates the direction of his foot upward and downward, he likewise has to break momentum with alternating directions of drag force. The scalloped edge allows for more uniform, and less disruptive momentum changes during kick. Thus, the scalloped edge according to embodiments of the invention provide advantages over the webbed edges of conventional designs.

According to an embodiment, a scalloped edge provides a repeating pattern of generally convex tubercles or protrusions extending from an otherwise planar edge. According to the embodiment shown in FIGS. 1 and 2, a scalloped edge 102 may be formed by several tubercles or protrusions extending from one portion of a fin to another portion, for example, along the top (distal) edge and/or along a lateral edge (left, as shown). As shown in the embodiments of FIGS. 1 and 2, the scalloped edge may have at least two rounded protrusions that are approximately the same size. According to other embodiments, the scalloped edge 102 of the swimming fin may vary in shape, geometry, position, spacing, size, or may vary in the number of tubercules or protrusions. For example, the irregular edge according to other embodiments may have more, or less, protrusions than as shown in the embodiment of FIGS. 1 and 2. According to other embodiments, the protrusions may be more closely spaced together, or more widely spaced apart, than as shown in the embodiment of FIGS. 1 and 2.

Figure 7A:
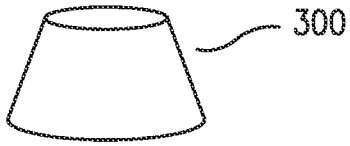
FIGS. 7*a*-7*b* are perspective schematic views of the direction of flow of a fluid over an inverted chamber.
Figure 7B:
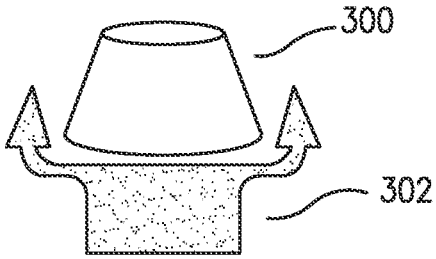

According to another embodiment, the swimming fin 100 may include valves, apertures, or tapered holes 104 that go through the top and bottom surfaces of the fin, and positioned near a medial side (right, as shown) of the fin. The valves 104 are designed to create greater resistance and buoyancy to the fin. For example, as shown in FIG. 7*a*, an empty cup or chamber 300 that is placed upside down over air or a fluid can initially provide buoyancy by creating an air pocket inside the cup or chamber. Buoyancy is the upward force that keeps objects afloat and is equal to the weight of fluid displaced by an object. However, such a cup would stop providing resistance once it is completely full of air or fluid inside it because, as shown in FIG. 7*b*, it would form a pressurized parabola that can cause additional air or fluid 302 to flow around the cup 300. Thus, the fluid 302 would submerge the cup 300 and it would lose all of its upward force and its buoyancy.

Figure 7C:
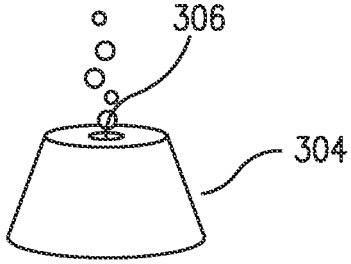
FIGS. 7*c*-7*d* show perspective schematic views of the direction of flow of a fluid over an inverted chamber with a release valve.
Figure 7D:
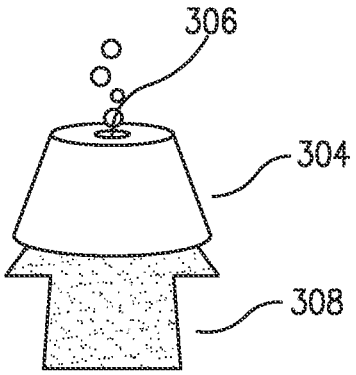

In contrast, as shown in FIG. 7*c*, a cup or chamber 304 having an opening or a release valve 306 and that is placed over air or a fluid is not initially as buoyant as the cup 300 without any valve, because air or fluid that collects in the cup

304 will escape through the valve 306. However, the cup 304 will start to form resistance, because the air or fluid 308 must pressurize inside the cup 304 in order to exit through the release valve 306. Thus, the cup 304 with a valve 306 will maintain buoyancy for a longer period of time than the cup 300 without a valve because it will stabilize as additional air or fluid continues to travel out the valve 306, but at a certain constant pressure. The constant pressure of cup 304 caused by release valve 306 provides a constant upward force that must be overcome with greater force than the inherent pressure inside the cavity of a cup 300 without a release valve, for the cup to lose its buoyancy and submerge in a fluid.

Thus, the valves 104 along a medial side (right, as shown in FIG. 1) of the swimming fin 100 can cause the effect of pressurizing the water that gathers on the underside of the fin and is forced through the valves, thereby creating greater buoyancy and resistance for the swimmer. According to the embodiment shown in FIGS. 1 and 2, the valves 104 may be several rectangular holes that are integrated into the fin along a medial edge. According to an embodiment, the valves may also be tapered, to decrease in size from the distal edge of the fin, which has a larger planar width, to the base portion of the fin, which has a smaller planar width. According to other embodiments, the valves 104 may vary in shape, geometry, position, spacing, size, or may vary in number. For example, the swimming fin may have more, or less, valves than as shown in the embodiment of FIGS. 1 and 2. Moreover, the valves 104 may be formed at various other portions of the fin, such as near the lateral and/or distal side of the fin.

According to another embodiment, the swimming fin 100 may include flow channels 106 across a surface of a fin. The flow channels 106 may be formed by grooves on a surface of the fin to guide the flow of water in a desired direction, for example, toward the open valves 104 as shown in FIGS. 1 and 2. Thus, the flow channels 106 also increase resistance and buoyancy because they guide larger amounts of water to flow through them to be ultimately forced through localized points of pressure at the valves 104, than would occur otherwise on a flat fin surface without the channels. The channels 106 may be configured to also help orient the foot into its ideal natural kicking position, by promoting moderate medial rotation. The flow channels 106 may be formed on both the top and bottom planar surfaces of the fin 100, as shown respectively in FIGS. 1 and 2, or alternatively, may be formed on only the top or the bottom planar surface. As shown, the flow channels 106 may be tapered to increase in size from one lateral edge of the fin (left, as shown) to the valves 104.

Figure 4:
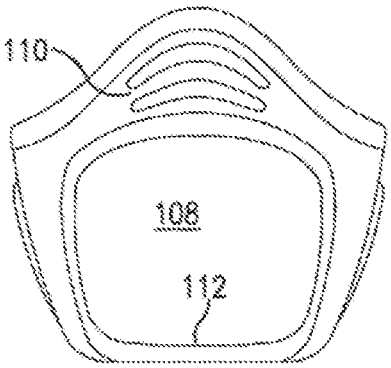
FIG. 4 is a rear view of a swimming fin according to an embodiment of the invention.

According to another embodiment, the swimming fin 100 may include a heel strapping system that is made of two components—an under heel strap 112 and a back heel strap 110. Thus, the heel strapping system according to an embodiment can add stability and comfort both under the heel and at the Achilles tendon area, and thus help reduce foot cramping or discomfort. As further shown by a rear view of an embodiment shown in FIG. 4, the fin may have a space 108 for the ankle that is similar to the space at the opening of a conventional open heel type strap. However, the two-piece heel strapping system shown in FIG. 4 is an improvement over conventional open heel fins that allow ankle flexion, which in turn creates more range of motion and promotes a faster kicking speed. That is, the problem of conventional open heel fins of not providing sufficient stability to a swimmer's foot at the heel is addressed by the under heel strap 112 of the illustrated embodiment. The heel strap 112 thus provides increased stability and security, without compromising ankle flexion, and thus allows a swimmer to comfortably maintain speed, power and range of motion from the blade of the fin.

But in addition, there is often a lot of stress on the heel strap of conventional open heel fins, which can cause discomfort or pain to a swimmer and even cause blisters to form at the Achilles tendon area of the ankle. To address this problem, the back heel support strap 110 of the heel strapping system according to embodiments of the invention can be further latticed to flex and articulate around various shapes of ankle bones and Achilles tendons, thus reducing pain and friction. The latticing can take various shapes and forms. According to an embodiment, the heel strapping system, including the lattice features, are all integrated by a single material. Thus, according to an embodiment as shown in FIG. 4, the two-piece heel strapping system formed by the latticed back heel strap 110 and under heel strap 112, can securely support both the under heel and the back heel of the foot, provide for adequate ankle flexion, and reduce foot cramping, discomfort and pain at the ankle.

A foot pocket 118 has a foot pocket lateral side 118*a* and a foot pocket distal side 118*b*.

A plurality of scallops (scalloped edge 102) includes a first set of scallops 103*a* on a portion of the fin lateral edge and a second set of scallops 103*a* on a portion of the fin distal edge.

According to another embodiment, the swimming fin 100 may include a grab-hole 114 at the instep, or at the top planar surface near the opening of the foot pocket 116, as shown in FIG. 1. Because fins that are wet may be slippery or difficult to put on, a convenient grabbing mechanism on the fin can help a swimmer put on the fin with ease. In the illustrated embodiment, the grabbing mechanism is a hole 114 at the instep that allows the swimmer to insert a finger through it to pull the entire fin over their foot in a single motion. According to other embodiments, the grab-hole 114 may vary in shape, position, size, or number. For example, the fin may have two or more grab-holes on the instep for use with two or more fingers, according to another embodiment.

Figure 8:
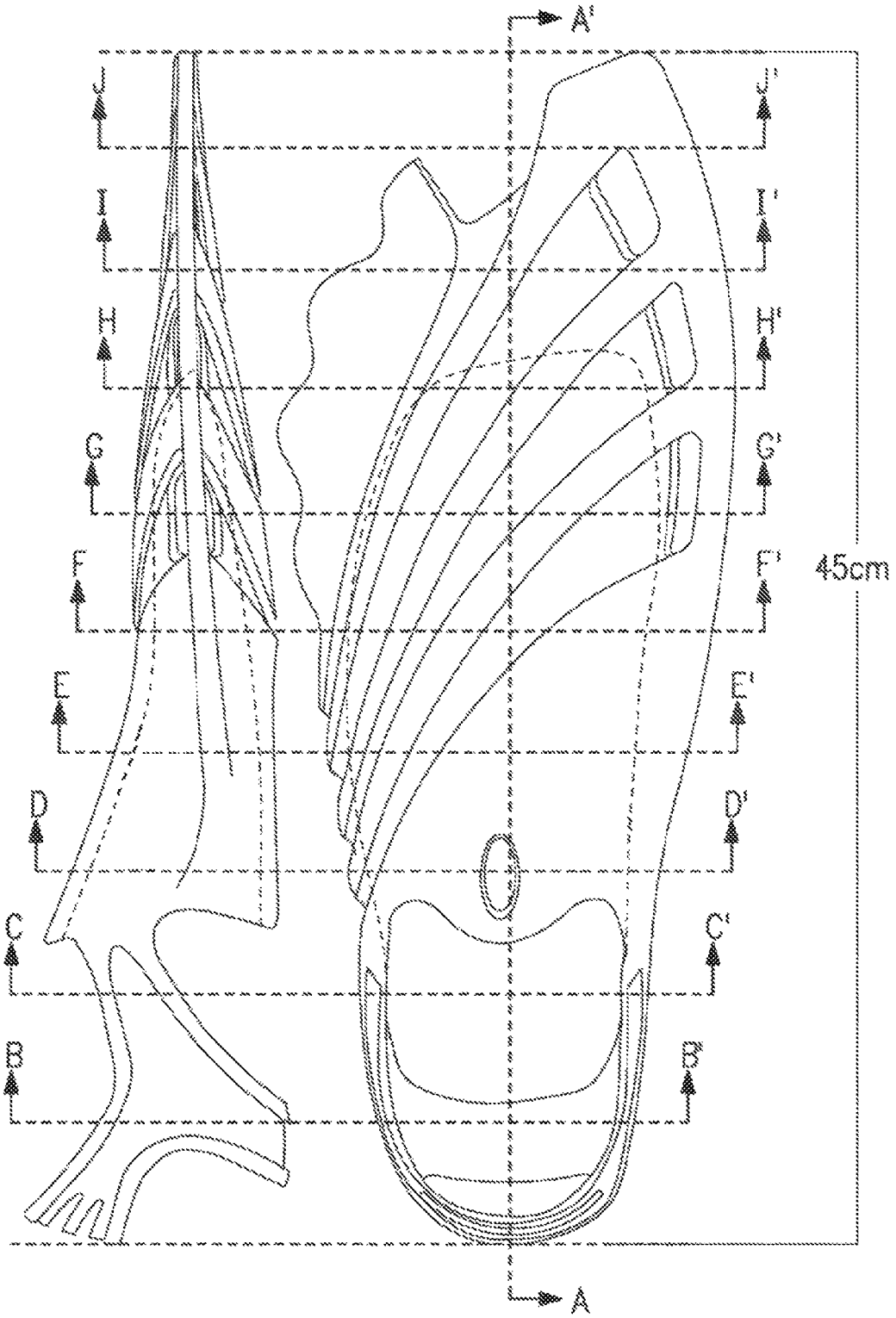
FIG. 8 shows side (left) and top plan (right) views of a swimming fin according to an embodiment of the invention.

FIG. 8 shows side and top plan views of a right-foot swimming fin according to an embodiment of the invention. FIG. 9*a*-9*j* show cross sectional views of the swimming fin according to the embodiment of FIG. 8, as indicated by the hatched lines.

Figure 9A:
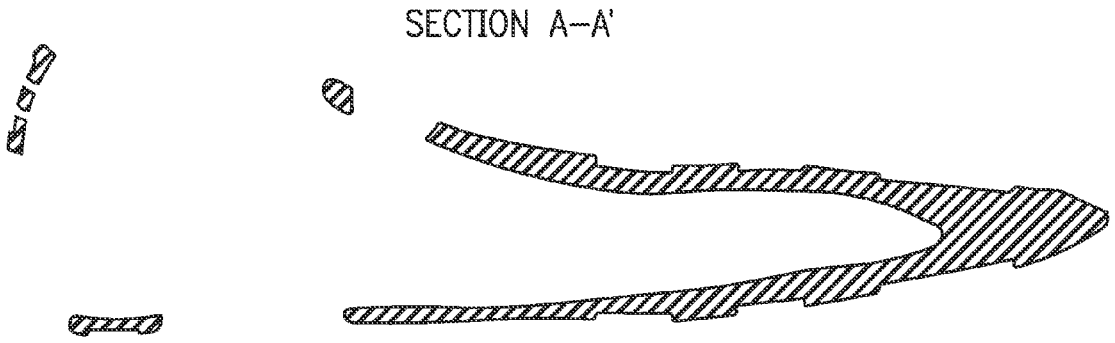
FIGS. 9*a*-9*j* are cross sectional views of a swimming fin according to the embodiment of FIG. 8 as indicated by the hatched lines.
Figure 9B:
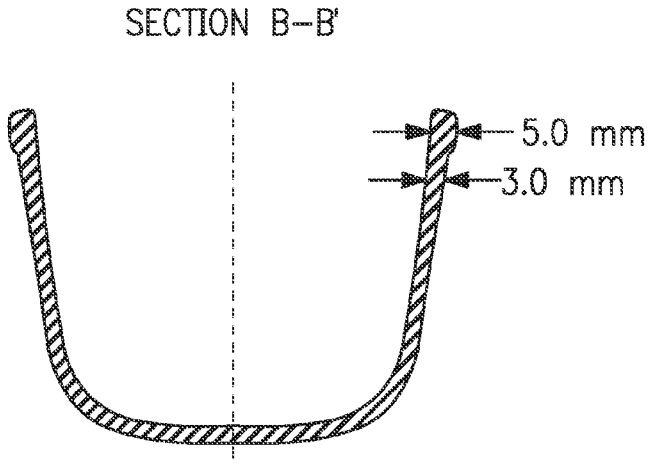
Figure 9C:
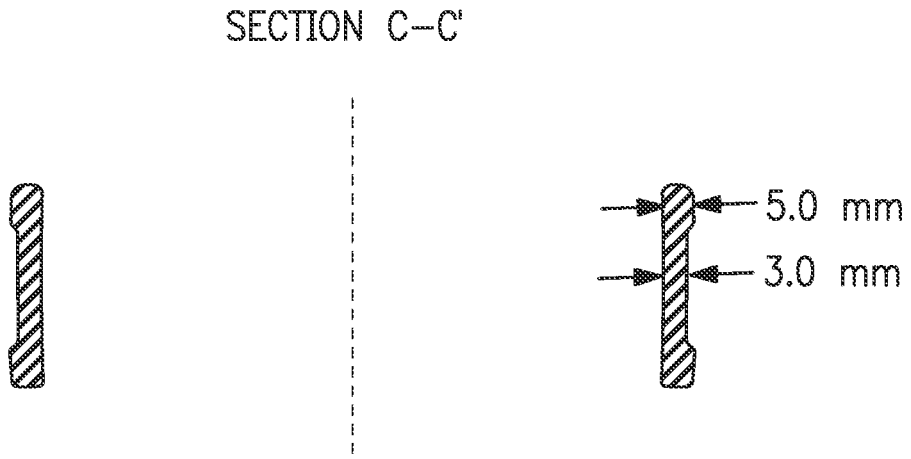

FIG. 9*b* shows a cross sectional view of the under heel support portion (112 in FIG. 1) of the two-piece strapping system according to an embodiment of the invention. As shown, the heel strap may be 3.0 mm in thickness throughout its length, and 5.0 mm at an upper lip near the base of the fin and near the opening of the foot cavity. FIG. 9*c* shows a cross section of a portion of the two-piece strapping system according to an embodiment where the under heel strap portion meets the back heel strap portion, and is shown to be 3.0 mm in cross section throughout, and 5.0 mm at both an upper lip and a bottom lip at the top and bottom edges of the portion that connects the under heel and back heel straps.

Figure 9D:
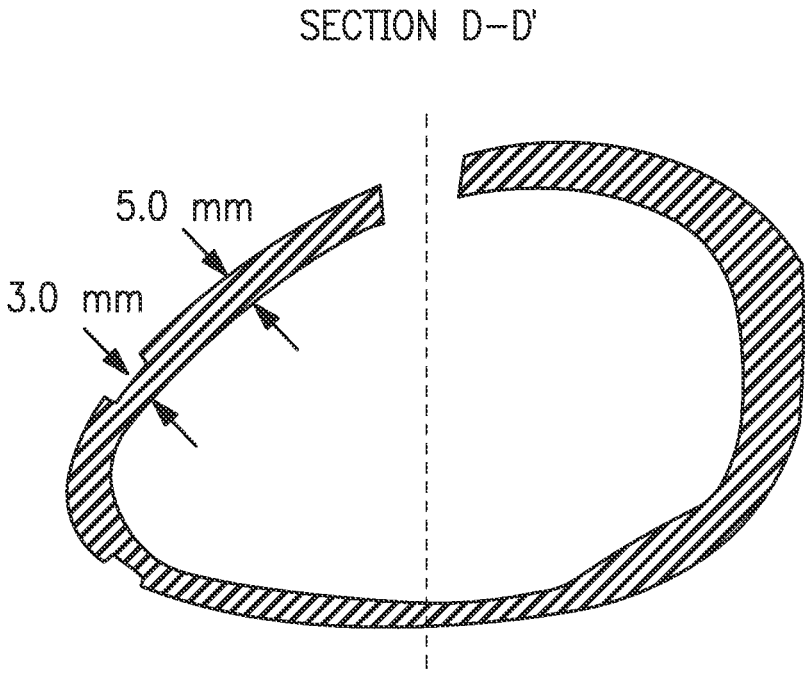
Figure 9E:
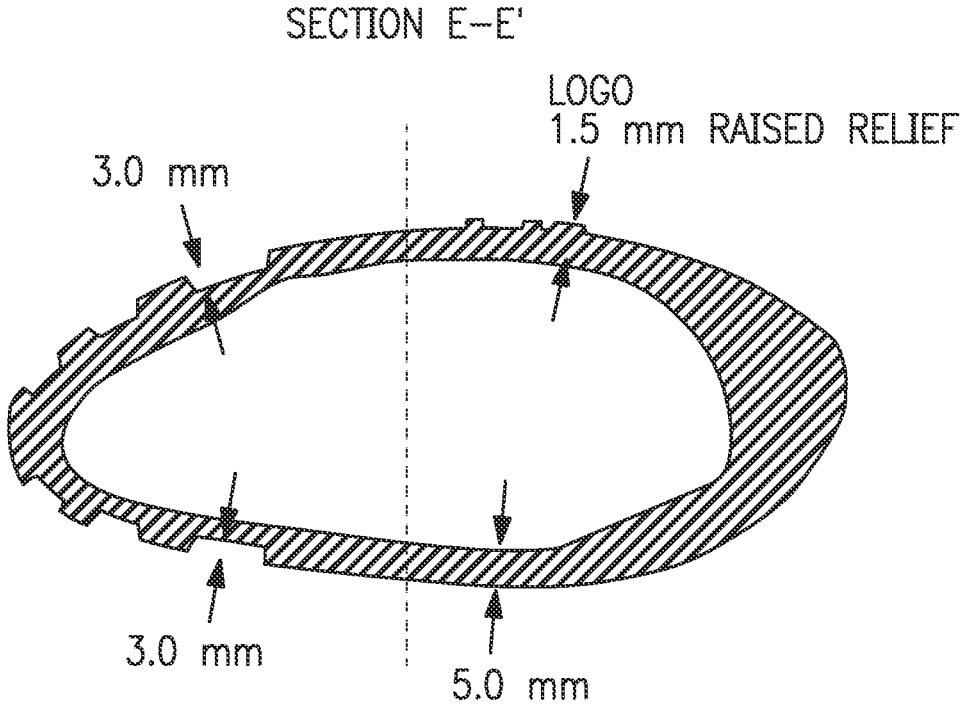
Figure 9F:
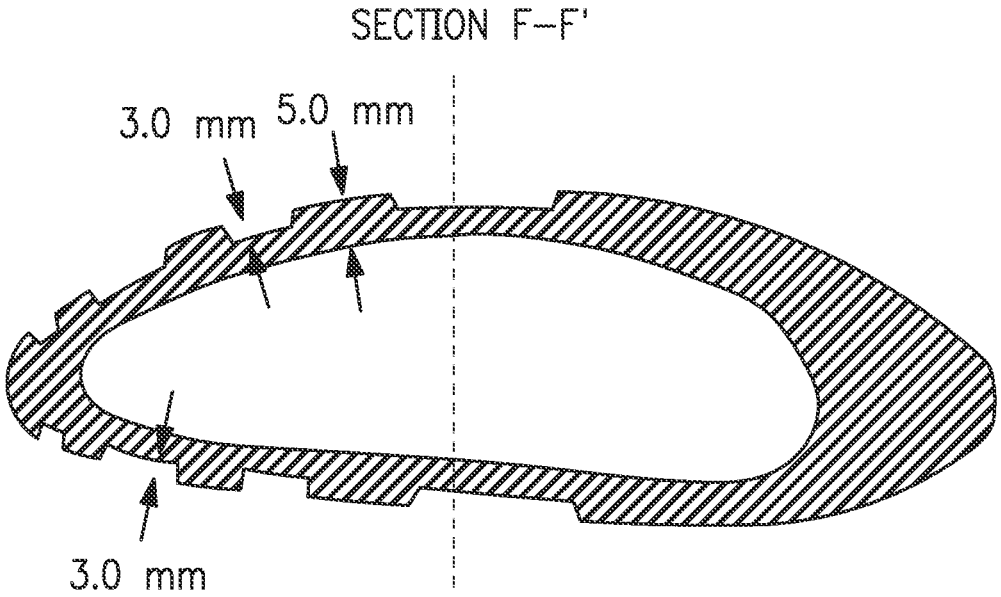
Figure 9G:
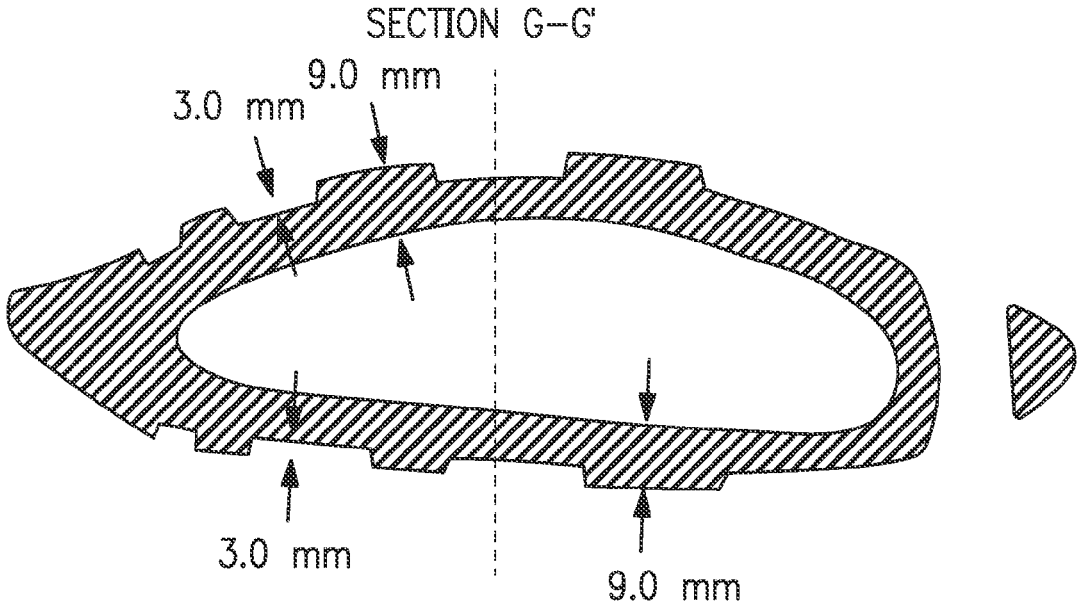
Figure 9H:
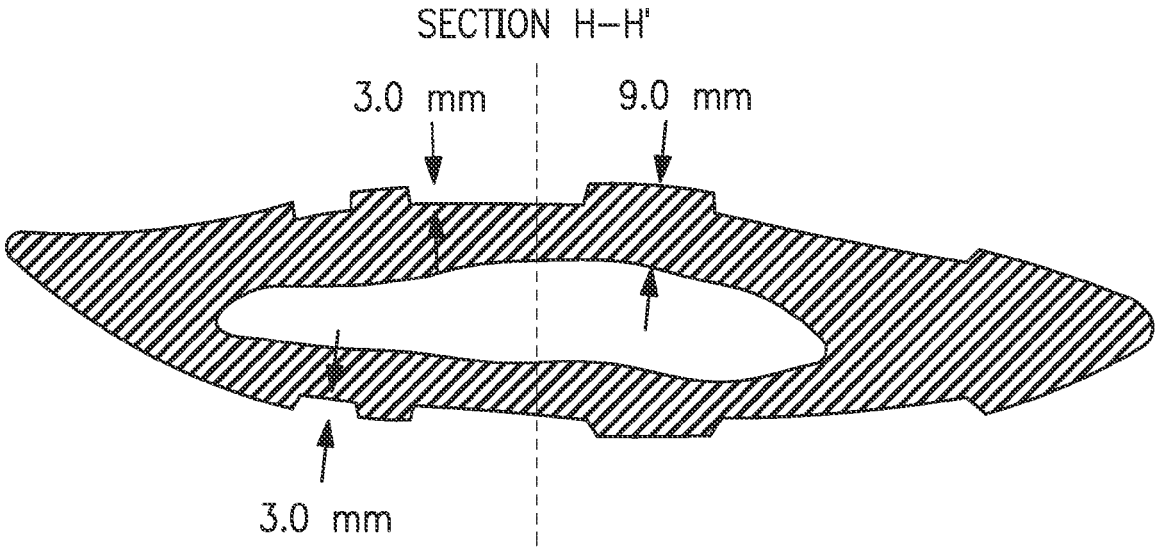
Figure 9I:
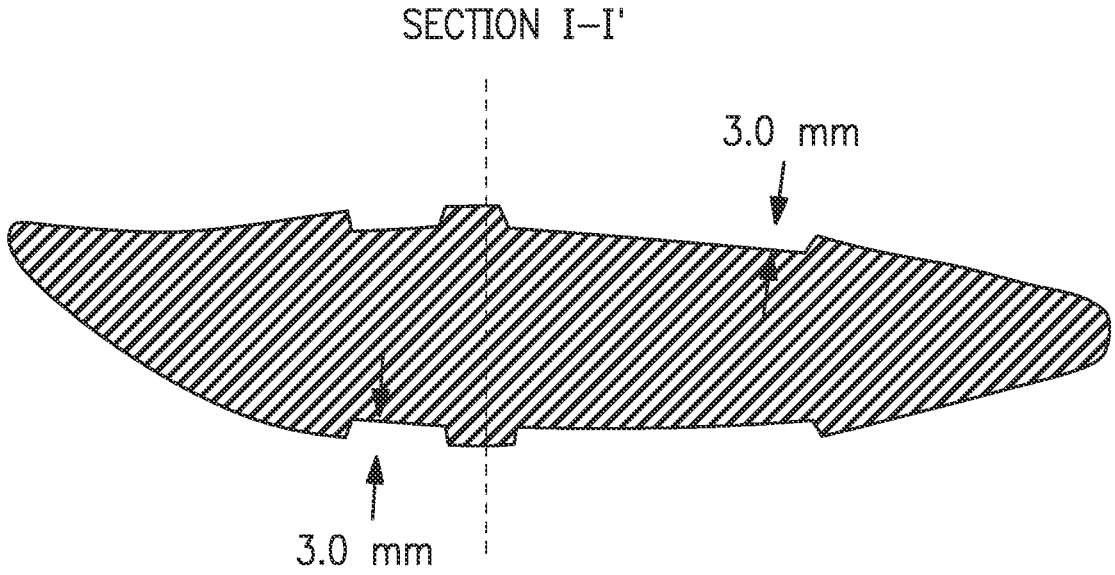
Figure 9J:
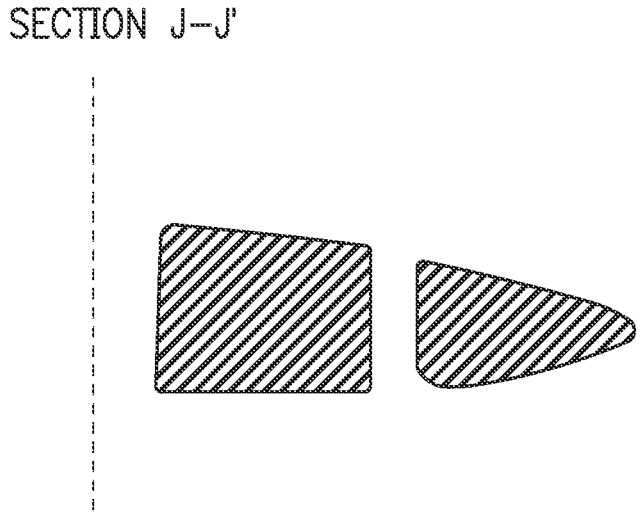

FIG. 9*d* shows a cross sectional view of a portion of the fin around the grab-hole opening (114 in FIG. 1). FIG. 6*d* shows a fin according to an embodiment to be generally 5.0 mm thick, but also including 3.0 mm thick depressions at the start of a first flow channel from the lowermost left lateral side on the top surface of the fin (106 in FIG. 1). FIGS. 9*e* and 9*f* show additional flow channels that are about 3.0 mm thick, on both the top and bottom surfaces of the fin. Flow channels according to other embodiments may have a thickness that is greater than 3 mm, or less than 3 mm. FIGS. 9*g* and 9*h* show an increase in the cross sectional thickness of the fin from its proximal end towards the distal end of the fin's blade, from about 5.0 mm to about 9.0 mm. According to other embodiments, the thickness of the fin may be less than or greater than 5.0 mm at its proximal end, or less than or greater than 9.0 mm at its distal end. FIG. 9*g* also shows a cross sectional view of a valve near the right medial side of the fin (104 in FIG. 1). FIGS. 9*i* and 9*j* show cross sectional views of portions near the distal edge of the fins blade and beyond the foot pocket or cavity inside the fin.

As noted above and addressed by various features according to embodiments of the invention, buoyancy is an important property of swimming fins. In particular, a swimmer must overcome the resistance caused by the upward force of a buoyant fin on the down-kick, which results in strength training and a faster and stronger kick while not wearing the fins. However, while embodiments of the invention provide for various features to increase the buoyancy of the fin, swimming fins according to embodiments may also be inherently buoyant by being made of highly buoyant material. The inherent buoyancy of the fins also helps naturally elevate the hips and feet of the swimmer to enforce proper body alignment and ideal horizontal body position in the water, even when the swimmer is not utilizing the various other features of the fin that promotes higher resistance, propulsion force and swimming speed. Moreover, swimming fins should not be so complex, burdensome or overly faithful to the biomechanics of an aquatic animal, as to distort a swimmer's natural swimming position in the water. Swimming fins according to embodiments may be viewed as lightweight extensions of the feet that can easily mimic a swimmer's natural kicking positions.

Thus, according to one embodiment, the swimming fin may be molded from a buoyant material such as an ethylene vinyl acetate (EVA) foam. EVA also has the advantage of being durable, rigid, and not easily subject to fatigue. According to other embodiments, the swimming fin may be made of other buoyant materials, such as TPR and PE foam. According to other embodiments, the swimming fin may be made of other materials, including but not limited to polyvinyl chloride, polyethylene, polypropylene, and other rubber and polymeric materials. According to other embodiments, the swimming fin may include composites or laminates such as fiber glass, reinforced plastic or graphite composites. According to embodiments, the entire swimming fin including the fin body and the dual-strapping system may be formed of a single integrated molded material for example, by being molded from conventional injection technology or injection molding technology. The swimming fin can be of any desired elasticity or stiffness, but is preferred stiff so as to resist stress fatigue.

Figure 10:
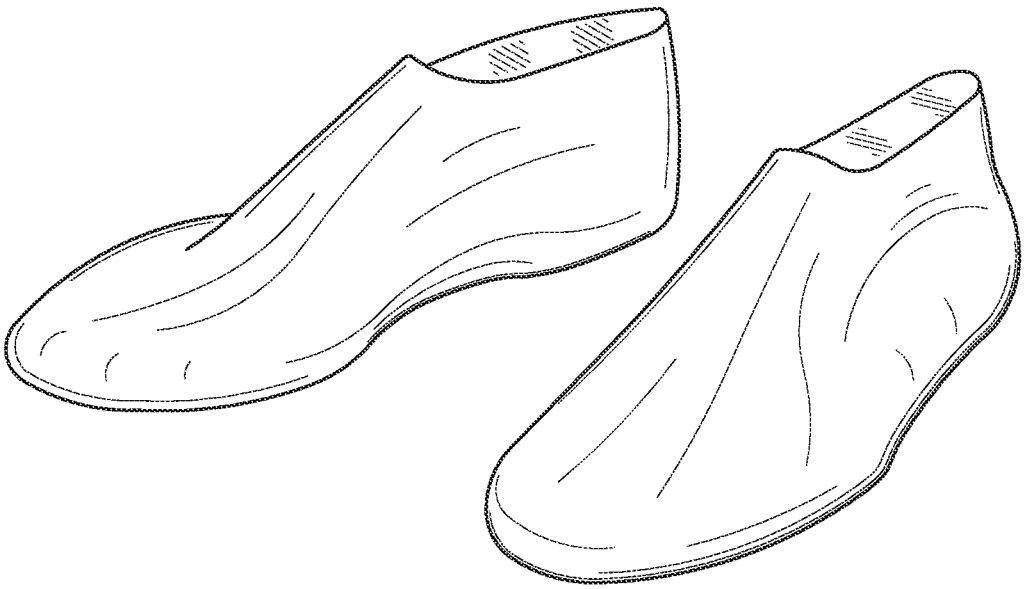
FIG. 10 is an illustration of a pair of footwear lasts.

According to an embodiment, the shape of the foot pocket or cavity of the swimming fin may be improved by forming the fin with a footwear last, thus improving the comfort level of the inner foot pocket. A footwear last is a mechanical form having the shape of a human foot and made of a hard material such as wood, iron or high density plastic, as shown in FIG. 10. Footwear lasts are typically used by shoemakers in the manufacture and repair of shoes. However, conventional fins are typically formed by using a generic insert for the foot cavity that approximately mimics the shape of a human foot. However, using a generally flat insert that does accommodate the shape of a foot can cause pinching and discomfort in the areas of the toes, the instep, the ball of the foot, and the arch of the foot, and thus potentially cause cramping and pain, or cause blisters and corns to form. The use of a footwear last in shaping a swimming fin to create a more accurate foot pocket cavity shape can greatly improve comfort to a swimmer, by allowing more space at the toes and by accommodating the curves of the ball, arch and instep of the foot. Using a footwear last can also better shape the two-part strapping system at the under heel and the back heel of the ankle to further maximize comfort that both the open heel and closed foot types of swimming fins currently lack.

While the present invention has been described with respect to what are currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation, so as to encompass all such modifications and equivalent structures and functions.

What is claimed is:

1. A swimming fin for a user, the swimming fin comprising:

a top surface, a bottom surface, a fin proximal edge, a fin distal edge, a fin lateral edge, and a fin medial edge;

a plurality of scallops comprising a first set of scallops on a portion of the fin lateral edge and a second set of scallops on a portion of the fin distal edge, the plurality of scallops being disposed continuously and arcuately on the respective portion of the fin lateral edge and the respective portion of the fin distal edge;

a plurality of apertures formed through the top surface and the bottom surface and connecting the top surface and the bottom surface, the plurality of apertures disposed proximal to the fin medial edge; and a foot pocket defined by an opening at the fin proximal edge, the foot pocket for receiving a foot of the user, the foot pocket comprising a foot pocket lateral side and a foot pocket distal side, the foot pocket lateral side being spaced from the fin lateral edge and the foot pocket distal side being spaced from the fin distal edge.

2. The swimming fin of claim 1, further comprising a flow channel extending across a portion of the top surface or a portion of the bottom surface, the flow channel directing water across the flow channel.

3. The swimming fin of claim 1, further comprising a first flow channel extending across a portion of the bottom surface and a second flow channel extending across a portion of the top surface, wherein the first and second flow channels extend to a single aperture of the plurality of apertures, the first and second flow channels directing water across the respective channels and through the single aperture of the plurality of apertures.

4. The swimming fin of claim 1, further comprising a foot securing portion connected to the proximal side for securing the foot through the opening, wherein the foot securing portion comprises a back heel strap integrated with an under heel strap.

5. The swimming fin of claim 1, further comprising a buoyant material.

6. The swimming fin of claim 5, wherein the buoyant material is an ethylene vinyl acetate foam.

7. The swimming fin of claim 1, wherein the foot pocket has a shape of a foot last.

8. A swimming fin for a user, the swimming fin comprising:

a plurality of fin body sides comprising a top surface, a bottom surface, and a plurality of fin body edges, the plurality of fin body edges comprising a fin proximal edge, a fin distal edge, a fin lateral edge, and a fin medial edge;

a plurality of scallops comprising a first set of scallops on a portion of the fin lateral edge and a second set of scallops on a portion of the fin distal edge, the plurality of scallops being disposed continuously and arcuately on the respective portion of the fin lateral edge and the respective portion of the fin distal edge;

a plurality of apertures formed through the top surface and the bottom surface and connecting the top surface and the bottom surface; and a foot pocket defined by an opening at the fin proximal edge, the foot pocket for receiving a foot of the user, the foot pocket comprising a foot pocket lateral side and a foot pocket distal side, the foot pocket lateral side and the foot pocket distal side being spaced from the plurality of fin body sides; and a first flow channel extending across a portion of the top surface or a portion of the bottom surface;

wherein the flow channel extends to one of the plurality of apertures, the flow channel directing water across the flow channel and through the one of the apertures;

wherein the one of the plurality of apertures is disposed proximal to a first fin body side, at least one of the plurality of scallops is disposed on a second fin body side, the first fin body side being opposite the second fin body side.

9. The swimming fin of claim 8, wherein the flow channel is a planar groove extending from the fin lateral edge to the one of the plurality of apertures.

10. The swimming fin of claim 8, wherein the aperture is rectangular.

11. The swimming fin of claim 8, wherein the flow channel is tapered from one channel end near the one aperture of the plurality to another channel end.

12. The swimming fin of claim 8, further comprising a second flow channel extending across a portion of the top surface, wherein the first and second flow channels extend to a single aperture of the plurality of apertures, the second flow channel directing water through the single aperture of the plurality of apertures.

13. The swimming fin of claim 8, further comprising a plurality of flow channels extending across a portion of the top surface and portion of the bottom surface, the plurality of flow channels extending to respective apertures in the plurality of apertures.

14. The swimming fin of claim 8, further comprising a buoyant material.

15. The swimming fin of claim 8, further comprising a foot securing portion connected to the proximal side for securing the foot, wherein the foot securing portion comprises a back heel strap integrated with an under heel strap.

16. The swimming fin of claim 8, wherein the foot pocket comprises a shape of a foot last.

17. A swimming fin for a user, the swimming fin comprising:

a fin body comprising a top surface, a bottom surface, a fin proximal edge, a fin distal edge, a fin lateral edge, and a fin medial edge;

a plurality of scallops comprising a first set of scallops on a portion of the fin lateral edge and a second set of scallops on a portion of the fin distal edge, the plurality of scallops being disposed continuously and arcuately on the respective portion of the fin lateral edge and the respective portion of the fin distal edge;

a plurality of apertures formed through the top surface and the bottom surface and connecting the top surface and the bottom surface, the plurality of apertures disposed proximal to the fin medial edge;

a foot pocket defined by an opening at the fin proximal edge, the foot pocket for receiving a foot of the user, the foot pocket comprising a foot pocket lateral side and a foot pocket distal side, the foot pocket lateral side being spaced from the fin lateral edge and the foot pocket distal side being spaced from the fin distal edge; and a foot securing portion connected to the fin proximal edge for securing the foot inserted into the foot pocket;

wherein the foot securing portion comprises a back heel strap and an under heel strap.

18. The swimming fin of claim 17, wherein the under heel strap and the back heel strap are integrated with the fin body by a single material.

19. The swimming fin of claim 17, wherein the back heel strap comprises an opening extending across the back heel strap.

20. The swimming fin of claim 17, wherein the back heel strap comprises a plurality of strap openings extending across the back heel strap.

21. The swimming fin of claim 17, wherein the fin body comprises a plurality of flow channels extending across a portion of the top surface and a portion of the bottom surface, wherein at least one of the plurality of flow channels extend to at least one of the plurality of apertures.

22. A swimming fin for a user, the swimming fin comprising:

a fin body comprising a top surface, a bottom surface, a fin proximal edge, a fin distal edge, a fin lateral edge, and a fin medial edge;

a plurality of scallops comprising a first set of scallops on a portion of the fin lateral edge and a second set of scallops on a portion of the fin distal edge, the plurality of scallops being disposed continuously and arcuately on the respective portion of the fin lateral edge and the respective portion of the fin distal edge;

a plurality of apertures formed through the top surface and the bottom surface and connecting the top surface and the bottom surface, the plurality of apertures disposed proximal to the fin medial edge;

a foot pocket defined by an opening at the fin proximal edge, the foot pocket for receiving a foot of the user, the foot pocket comprising a foot pocket lateral side and a foot pocket distal side, the foot pocket lateral side being spaced from the fin lateral edge and the foot pocket distal side being spaced from the fin distal edge;

a foot securing portion connected to the fin proximal edge of the fin body for securing the foot inserted into the foot pocket;

wherein the foot pocket comprises a shape of a foot last.

23. The swimming fin of claim 22, wherein the fin body comprises a gripping mechanism positioned near the opening and configured to allow a user to pull the fin body over a foot.

24. The swimming fin of claim 23, wherein the gripping mechanism comprises a hole formed through the top surface of the fin body and configured to allow insertion of a finger through the hole.

25. The swimming fin of claim 22, wherein the foot pocket is configured to accommodate an instep and an arch of the user.

26. The swimming fin of claim 22, wherein the fin body comprises a plurality of flow channels extending across a portion of the top surface of the fin body and a portion of the bottom surface of the fin body, wherein at least one of the plurality of flow channels extend to at least one of the plurality of apertures.

* * * * *